United States Patent [19]

Kinzli

[11] Patent Number: 4,939,960

[45] Date of Patent: Jul. 10, 1990

[54] ELECTRICAL ENCLOSURE WRENCH

[76] Inventor: Lee A. Kinzli, P.O. Box 8714, Newport Beach, Calif. 92658

[21] Appl. No.: 389,791

[22] Filed: Aug. 4, 1989

[51] Int. Cl.[5] ..... B25B 13/06

[52] U.S. Cl. ..... 81/124.4; 81/125.1; 81/177.2; 81/177.4

[58] Field of Search ..... 81/124.4, 125.1, 177.1, 81/177.2, 177.4, 177.85, 462, 180.1, 185.2, 490, 184, 177.5, 437–439, 57.5; 7/100; D8/17, 22, 28, 29

[56] References Cited

U.S. PATENT DOCUMENTS

| | | | |
|---|---|---|---|
| D. 160,645 | 10/1950 | Milo | 81/460 X |
| D. 276,124 | 10/1984 | Liu | D8/22 |
| 910,789 | 1/1909 | Cunningham | 81/57.5 |
| 2,644,359 | 7/1953 | Lydle | 81/124.4 |
| 3,276,299 | 10/1966 | Halburian | 81/124.4 |
| 4,125,913 | 11/1978 | Lewis | 81/124.2 X |
| 4,236,266 | 12/1980 | Hannah et al. | 7/100 |
| 4,291,425 | 9/1981 | Sweitzer | 81/124.4 X |
| 4,620,462 | 11/1986 | Parker | 81/177.5 X |

FOREIGN PATENT DOCUMENTS

| | | | |
|---|---|---|---|
| 758860 | 10/1956 | United Kingdom | 81/124.4 |

*Primary Examiner*—D. S. Meislin
*Attorney, Agent, or Firm*—Gordon K. Anderson

[57] ABSTRACT

An electrical enclosure wrench which has a pair of crossbar shanks (20) forming a cross, each end containing a square tip (22) and a ball detent (24). A parking stand (26) is located between each shank, also having tips and detent as above. The center of the wrench is joined by welding, using a forged center (36) or a pair of conformal plates (42) riveted together. Each square tip contains a different tool head socket (34) having a specialized shape to fit an electrical enclosure lid or door. The sockets may be removed or interchanged, as desired, and the wrench is used with the crossbar becoming the lever and also may be spun to rotate the fastener in place.

9 Claims, 2 Drawing Sheets

ELECTRICAL ENCLOSURE WRENCH

TECHNICAL FIELD

The present invention relates to hand tools in general. More specifically, to a wrench having crossbar shanks to which various sockets and tool heads are attached, also parking stands for storing sockets that are not in use.

BACKGROUND ART

Previously, many types of tools have been in use to loosen or tighten fasteners. For many years a lug wrench, common to the automotive field, has been used to rotate lug bolts on wheels. While the principle of using a crossbar tool with a recessed socket on each end and using the opposed arms of the bars as a handle is old and well known in the art, it has been limited in its application and not been adapted with additional improvements and other utility to any great extent. Some prior art has utilized the same basic style for other purposes and pedals have been added to allow the use of ones foot to break loose the lug nut.

A search of the prior art did not disclose any patents that read directly on the claims of the instant invention, however, the following U.S. patents were considered related:

| U.S. Pat. No. | Inventor | Issue Date |
|---|---|---|
| DES. 276,124 | Liu | Oct. 30, 1984 |
| 4,291,425 | Sweitzer | Sep. 29, 1981 |
| 4,125,913 | Lewis | Nov. 21, 1978 |
| DES. 160,645 | Milo | Oct. 24, 1950 |
| 910,789 | Cunningham | Jan. 26, 1909 |

Liu, in his design patent, discloses a multi-use handle tool with a screwdriver blade and spanners on one end and a self-adjusting hex head wrench on the other with a socket in the middle, creating a type of cross.

Sweitzer teaches a cross or X-type automobile lug wrench having fixed or removable sockets on each end with a pedal step on the opposed shafts, one of which is sharpened and bent for hubcap removal, and the other is angled and proportioned to allow the step-carrying shafts to be on a line extending through the socket shaft such that the center of gravity permits ones foot to be used for leverage.

Lewis discloses an elongated cylindrical handle with an internally threaded socket on one end and a taper on the other end. The socket end fits a shower arm and the other end is insertable into a gas log lighter flange. A torque shaft grip is removably located in the middle of the handle for use as a crossbar and also contains a flat and a Phillips screwdriver blade on the ends.

Milo in a U.S. design patent employs a cross-shaped tool with each end containing a different shape that mates with tank caps presumably for removal and replacement thereof.

Finally, Cunningham, in a very early patent, teaches a watchmakers tool with a number of sleeve wrenches for removing the pendant of a stem winding watch. The wrenches are rotatably mounted between a pair of shells with a handle on one side and a spring loaded ratchet-like head allowing the wrenches to rotate within the shell.

DISCLOSURE OF THE INVENTION

While many different sized tools are available, a worker usually carries the entire set as various types of fasteners may be encountered while in the field. Tools by their very nature are heavy and sometimes bulky and require a box or bay large enough to carry the needed assortment. In the heavy electrical construction, maintenance, and repair industry, particularly where large high voltage transformers are mounted on pads, or in various types of underground vaults and enclosures, specialized tools are required where lids and doors are exposed to the public. These specific tools are required to remove and replace the so-called TAMPERPROOF screw, 5-sided pentahead safety head screw in different sizes, as well as large, flat slots. While individual tools for each size are commercially available, the need is present to combine the frequently used tools into a single wrench large enough to break even the tightest frozen fastener and yet small enough to be easily carried by a worker.

It is, therefore, a primary object of the invention to provide such a wrench that would have removable sockets fitting the fasteners of the majority of electric enclosures found in public and private electrical utilities and in the entire heavy electric industry requiring only one tool to be brought to the job site that is easily transported and stored.

An important object of the invention utilizes individual sockets that are removable and changeable allowing the most widely used sockets to be utilized on the working end and the balance to be stored at the convenient parking stands. This allows the tool to be used without assembly or valuable time being wasted trying to find the correct socket in the tool box or truck for each application. When an enclosure requires a different socket, a simple change may be made to the tool by merely reversing the sockets without loss or misplacement.

Another object of the invention is the ability of the tool to be used in conjunction with standard available sockets and tool heads for other applications. While the prime purpose of the tool is for the heavy electrical industry for opening specific enclosures, the handle portion may easily be adapted for use in other areas by replacing the sockets with conventional styles as the square shank is made in the standard ⅜ or ½-inch size which is universally available in this country.

Still another object of the invention is directed toward the leverage of the tool for removing fasteners that have been in place for long periods of time or corroded in place. Since the tool itself is preferably 16-inches (41 cm) long in the ⅜-inch drive and 24-inches (61 cm) long in the ½-inch drive, no need is required for additional breaker bars or handle extensions.

Yet another object of the invention is the quick and easy method of removing or installing a nut or screw. This is accomplished by holding the end of the crossbar in line with the fastener with one hand and spinning the opposite crossbar with the other. This method of rotation is fast and yet controlled, also, the flywheel effect is utilized when spinning which provides continual torque by virtue of the mass of the tool itself.

A final object of the invention is the simplicity of operation and ease of manufacture, making the tool cost effective as little labor is required for fabrication and assembly and no complicated instructions are necessary for operation.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred, second, and third embodiments. All three embodiments are primarily designed alike, except for the attachment of the crossbars and shape of the ends of the stands.

Figure 1:
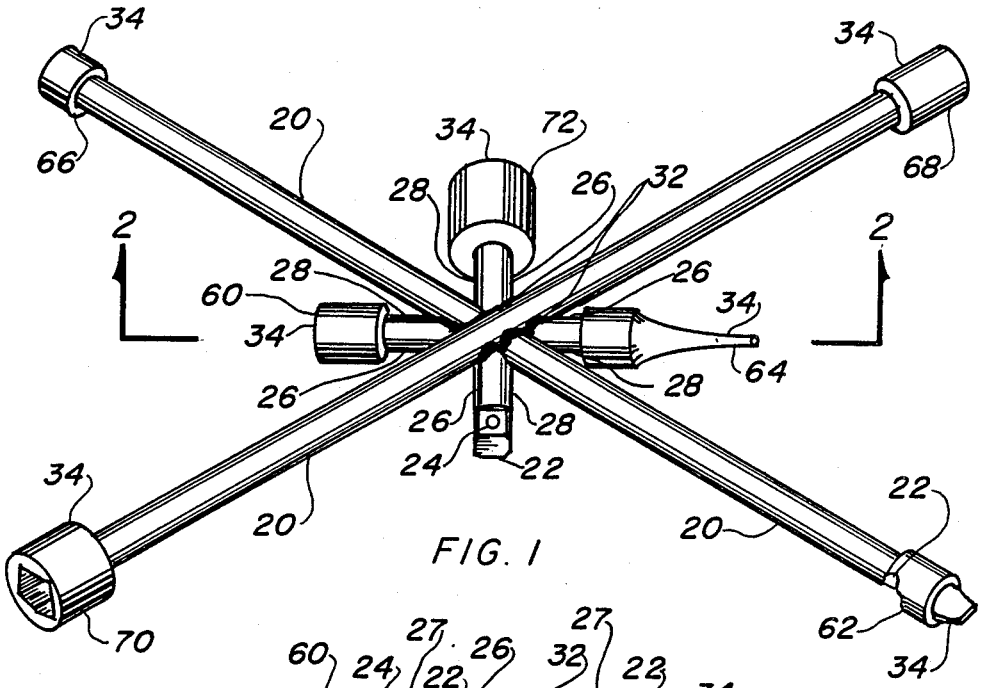
FIG. 1 is an isometric view of the preferred embodiment with the crossbar shanks and stands welded.
Figure 2:
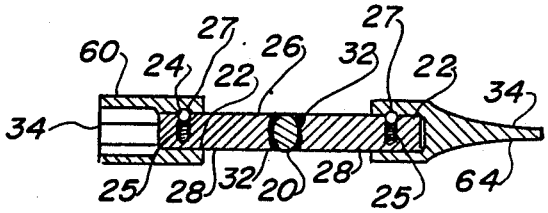
FIG. 2 is a cross-sectional view taken along lines 2—2 of FIG. 1.

The preferred embodiment, as shown in FIGS. 1 and 2 is comprised of a pair of crossbar shanks 20 that are positioned at right angles to each other forming a cross or an X. The ends contain a square tip 22 with an exposed spring loaded ball detent 24 on one of the square flat surfaces. The ball detent 24 is well known in the art and consists of a hole within the tip in which a compression spring 25 and metallic ball 27 are placed. A small emount of metal is displaced or cupped around the ball on the outside surface holding it in place allowing the ball to be depressed into the hole and, yet, spring back to its partially protruding position.

Figure 5:
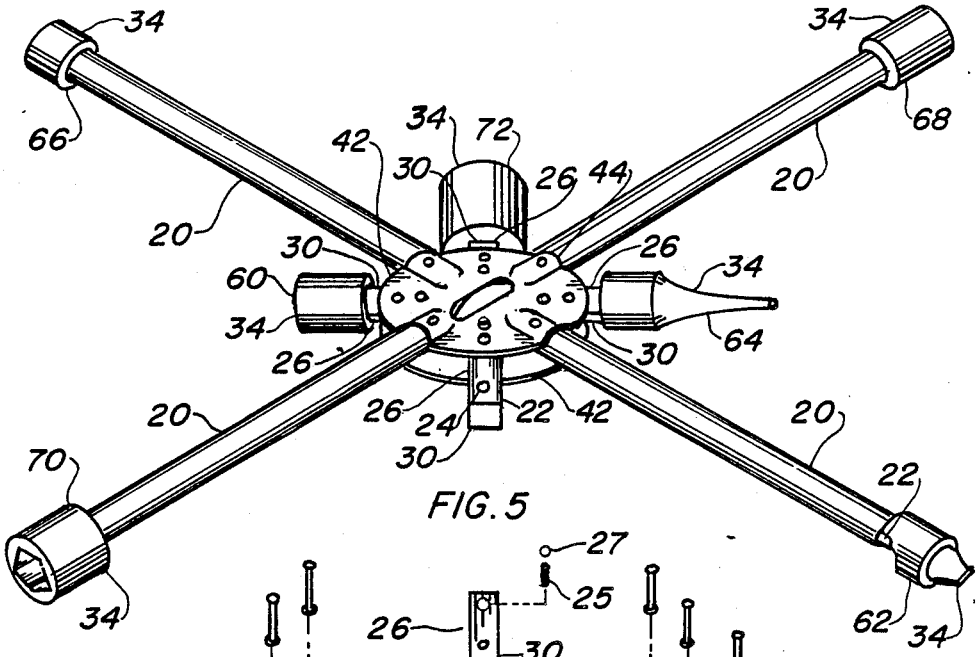
FIG. 5 is a partial isometric view of the third embodiment completely assembled.
Figure 6:
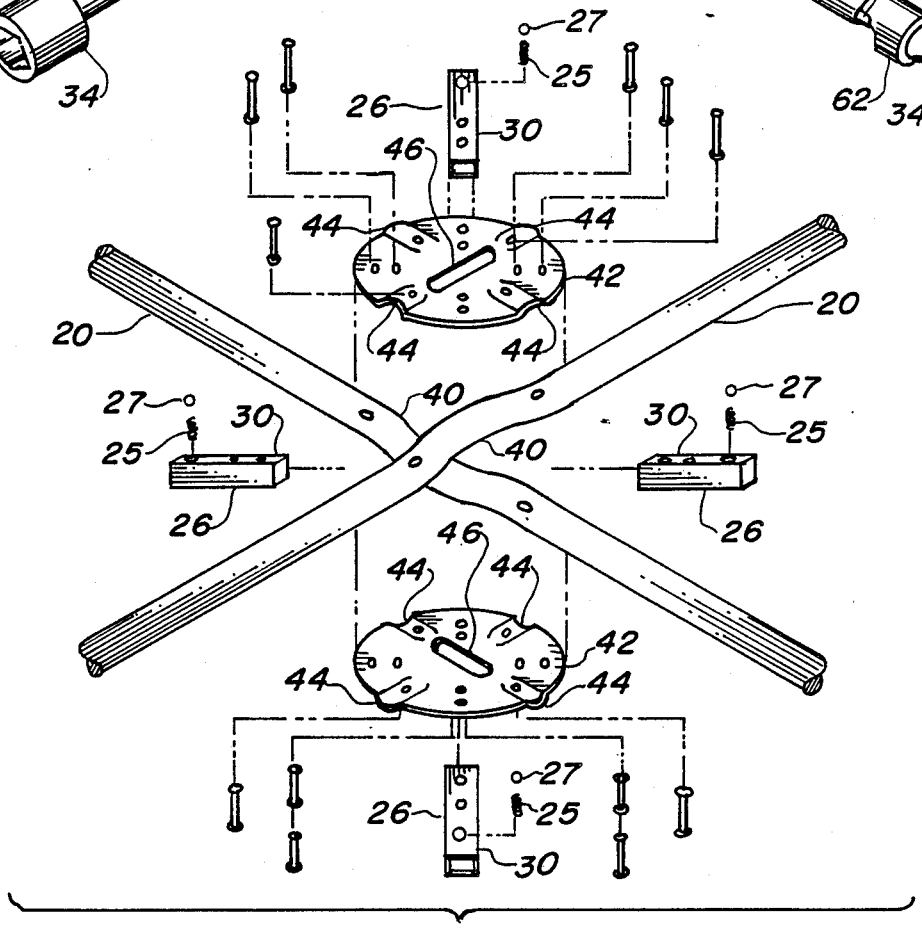
FIG. 6 is an exploded view of the third embodiment with the offset crossbar shanks, a pair of conformal plates attached together and square parking stands.

A number, preferably four, of socket retaining parking stands 26 are spaced at the intersection of the shanks 20. Each stand 26 contains a square tip 22 identical to those on the crossbar shanks 20. Further, each tip 22 contains a ball detent 24 exactly the same as described above. The stands 26 may be either round 28 on the end opposite the square tip 22, as shown in FIGS. 1 and 2 the same diameter as the shanks 20, or dimensionally configured square 30 the same size as the tip 22, as shown in FIGS. 5 and 6, either configuration functioning equally well.

The crossbar shanks 20 and parking stands 26 are joined together with one of the shanks 20 having a center section removed, as shown in FIG. 1, such that when positioned at right angles to the other the extending end is the same length from the center. Center joining means consist of welding 32 the shanks 20 and stands 26 together permanently on the same level, creating a planar tool with the shanks providing opposed handles for turning and straight handle for gripping with the remaining end of the shank for interfacing with a lid or door fastener commonly encountered in the heavy electrical industry.

At the square tips 22 of both the shanks 20 and stands 26 a tool head socket 34 is attached. These sockets 34 consist of a conventional tool that is normally used in sets and, again, as with the detents 24, is well known in the art. The sockets 34 are composed of a cylindrical sleeve with a square hole in one end and a recessed socket in the other, the reverse configuration of the fastener to be used, such as hexagonal or square. In this case, the sockets 34 are selected for a specialized type of fastener commonly used in the heavy electrical industry, as previously described, which are designed such that conventional tools, including adjustable spanners, open end or box end wrenches will not fit properly. The use of a 5-sided or pentagon shaped head, also known as a safety head, is common, as no two sides are parallel, also a special multi-toothed shape is used known by its registered trademark TAMPERPROOF head. Further, other sockets or tool heads, such as flat, Phillips, screwdriver head, allen hex, or drift pin heads, or the like, add to the utility of the tool requiring only one device to be taken to the job site, instead of a complete tool box. At any rate, these specialized and standard sockets have a common size and method of attachment. The industry has basically standardized on a so-called ⅜ or ½-inch drive which is nominally 0.375-inch (0.950 cm) square or 0.500-inch (1.27 cm) square which corresponds to the tip 22 size allowing attachment and removal as they interface between each other. Further, the ball detents 24 are depressed into the tip 22 when the sockets 34 are pressed on and a slight recess on each interior flat surface removably retains the socket in place by the loading of the spring on the ball and, yet, allows removal by overcoming the tension.

While any particular combination of sockets may be used on the tool with equal ease, it has been found that in the industry to which the tool is presently directed the following sockets have proven ideal in nominal size and configuration:

(1) one TAMPERPROOF screw head socket 60
(1) one flat screwdriver head socket 62
(1) one drift pin head socket 64
(1) one ⅜-inch five-sided safety head socket 66
(1) one ½-inch five-sided safety head socket 68
(1) one ⅝-inch five-sided safety head socket 70
(1) one ¾-inch five-sided safety head socket 72

It will be noted that only seven of the eight square tips 22 have sockets. This allows one to be left empty at the users option or one stand 26 may be used to receive a particular socket 34 that has been removed from one of the working tips 22 on the crossbar shank 20 prior to replacement by one on the parking stand 26.

The material for the wrench is metal, preferably steel that has sufficient strength for the application or is heat treated to harden the structure to prevent wear and bending. While any length of crossbar shanks 20 may be used, it has been found that 16-inches (41 cm) total length for the ⅜-inch drive and 24-inches (61 cm) for the ½-inch drive has proven optimum.

Figure 3:
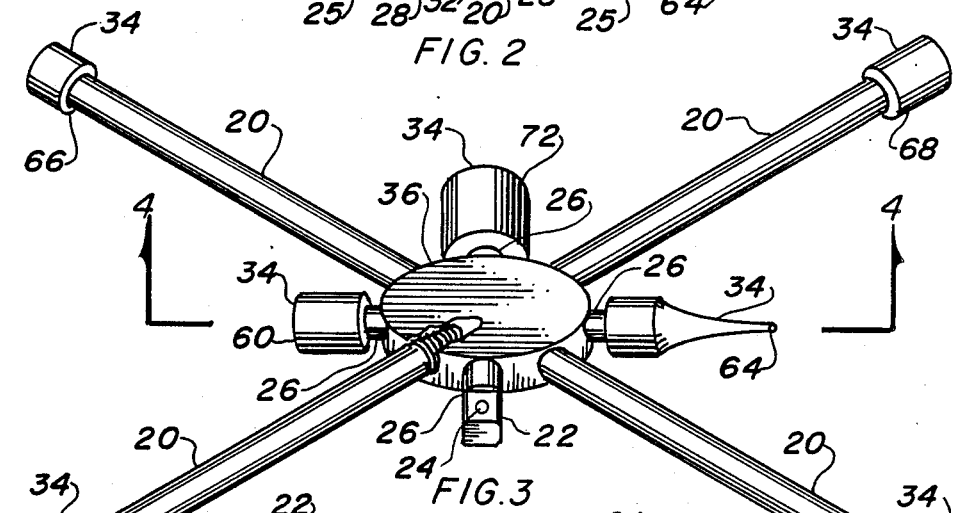
FIG. 3 is a partial isometric view of the second embodiment with a forged center joining means holding the crossbars and stands together with a center portion cut-away for clarity.
Figure 4:
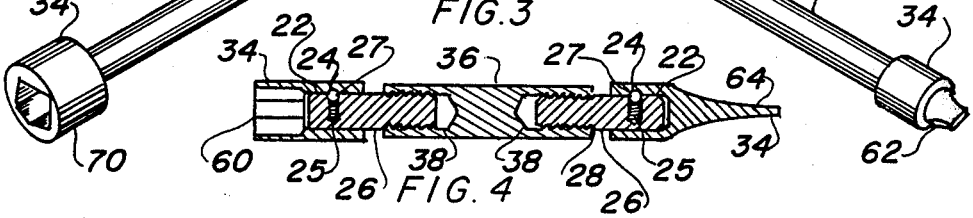
FIG. 4 is a cross-sectional view taken along lines 4—4 of FIG. 3.

The second embodiment is illustrated in FIGS. 3 and 4 and is identical to the preferred embodiment, except the center joining means have the middle section of both crossbar shanks 20 removed with a forged center 36 positioned therein. The center 36 has a bore 38 provided for each shank 20 and stand 26. The inside end of the shanks 20 and stands 26 are inserted into these mating bores 38 allowing a permanent fit to be formed. This fit may be threads, as shown in FIG. 4, or shrink fit, using the expansion of one of the metal elements with heat and the contraction of the other with cold temperatures. Other types of joints or fits may be equally acceptable, such as hot or cold forming, riveting, bolting, anerobic chemicals, epoxies, adhesives, and the like. The forged center itself may be fabricated of any suitable material, however, steel is preferred.

The third embodiment, depicted in FIGS. 5 and 6, is, again, the same as the preferred embodiment with the exception of the center joining means and the shanks 20 which now contain an offset 40 in the middle half, the thickness of the shank diameter allowing the shanks to nest symmetrically when crossed in the middle. This configuration allows both shanks 20 to be identical and eliminates the necessity to omit a portion of one or both as required in the other two embodiments. The center joining means consists of a pair of conformal plates 42, one on each side, which attach together with rivets, or the like, through the shanks 20 and stands 26 forming a permanent joint. The plates 42 are preferably round and are formed with raised or upset portions that radially interface with the shanks 20 while a slot 46 receives the offset 40 portion of the shanks 20. It is preferred that the square stands 30 are used in this embodiment, as the plates 42 fit flat against the two sides making the joint tight and rigid between the flat surfaces. The plates 42 are die stamped and formed and are both made the same and assembled oppositely with the preferred material steel, however, other metals will also function satisfactorily.

In use, the wrench is positioned with the appropriate socket 34 inserted on top of the fastener. The user then holds the opposite end of the shank 20 with one hand and places the other hand on the opposed crossbar using the leverage to break away the fastener and then spinning the wrench to back it out. Reassembly is accomplished in an opposite procedure. The crossbar is long enough to provide sufficient leverage to torque the fastener properly. The parking stands 26 provide convenient storage for the sockets 34 and interchanging is easily accomplished, as required.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

I claim:

1. An electrical enclosure wrench for lid and door fastener attachments comprising:

(a) a pair of crossbar shanks, centrally positioned at right angles to each other forming a cross, having a square tip on each end with an exposed spring loaded ball detent on the tip;

(b) a plurality of socket retaining parking stands having a first and second end, each stand contiguously spaced at the intersection of said shanks, further having a square tip on the first end with a spring loaded ball detent therein;

(c) center joining means rigidly attached to said crossbar shanks at their center and to the second end of said parking stands, said shanks providing an opposed handle for turning and a straight handle for gripping with a remaining end interfacing with a lid or door fastener; and (d) each square tip having a different tool head socket affixed thereon, held in place by the ball detents, allowing different fasteners on an electrical enclosure lid or door to be rotated in either direction by turning and gripping the crossbar shanks, further the square ends of the shanks and stands allow said sockets to be changed and stored as required to fit a particular application.

2. An electrical enclosure wrench for lid and door fastener attachments comprising:

(a) a pair of crossbar shanks, centrally positioned at right angles to each other forming a cross, having a square tip on each end with an exposed spring loaded ball detent on the tip, the pair of crossbars being formed as two arm members welded to the center of the other crossbar, each end is equidistant from the center and on the same plane;

(b) a plurality of socket retaining parking stands having a first and second end, each stand contiguously spaced at the intersection of said shanks, further having a square tip on the first end with a spring loaded ball detent therein;

(c) center joining means rigidly attached to said crossbar shanks as the center and to the second end of said parking stands, said shanks providing an opposed handle for turning and a straight handle for gripping with a remaining end interfacing with a lid or door fastener; and said center joining means further comprise welded joints attaching the crossbar shanks and parking stands together forming a homogeneous mass; and (d) each square tip having a different tool head socket affixed thereon, held in place by the ball detents, allowing different fasteners on an electrical enclosure lid or door to be rotated in either direction by turning and gripping the crossbar shanks, further the square ends of the shanks and stands allow said sockets to be changed and stored as required to fit a particular application.

3. An electrical enclosure wrench for lid and door fastener attachments comprising:

(a) four arm members having a first and a second end, a square tip on each first end with an exposed spring loaded ball detent on the tip;

(b) a plurality of socket retaining parking stands having a first and second end, each stand having a square tip on the first end with a spring loaded ball detent therein;

(c) center joining means rigidly attached to said second end of said arms and second end of said parking stands, said arms providing an opposed handle for turning and a straight handle for gripping with a remaining end interfacing with a lid or door fastener, said center joining means further comprising a forged center with a plurality of bores, mating with a respective second end of said arms and stands such that a permanent joint is formed;

(d) said central joining means having a central portion, the first end of each arm being equidistant from the central portion, said arms and said center joining means lying in the same plane, said four arm members comprising a first and second arm lying perpendicular to a third and fourth arm;

(e) each square tip having a different tool head socket affixed thereon, held in place by the ball detents, allowing different fasteners on an electrical enclosure lid or door to be rotated in either direction by turning and gripping the arms, the square ends of the arms and stands allow said sockets to be changed and stored as required to fit a particular application.

4. The electrical enclosure wrench as recited in claim 1 wherein said crossbar shanks further comprise an offset in the center thereof half of the thickness of the shank such that when the shanks are positioned together, they nest symmetrically, and said center joining means having a pair of conformal plates one on each side attached together with rivets forming a permanent joint.

5. The electrical enclosure wrench as recited in claim 1 wherein said socket retaining parking stands are entirely square of a dimensional configuration the same as the tip such that commercially available sockets will fit thereupon.

6. The electrical enclosure wrench as recited in claim 1 wherein said socket retaining parking stands are round on the second end, the same size as the crossbar shanks.

7. The electrical enclosure wrench as recited in claim 1 wherein said tool head sockets further comprise:

(a) a TAMPERPROOF screw head socket
(b) a flat screwdriver head socket
(c) a drift pin head socket
(d) a five-sided safety head socket, $\frac{3}{8}$ size
(e) a five-sided safety head socket, $\frac{1}{2}$ size
(f) a five-sided safety head socket, $\frac{5}{8}$ size
(g) a five-sided safety head socket, $\frac{3}{4}$ size.

8. The electrical enclosure wrench as recited in claim 1 further comprises said crossbar shank square tips and said socket retaining parking stand square tips on the first end correspond in size to a $\frac{3}{8}$-inch drive.

9. The electrical enclosure wrench as recited in claim 1 further comprises said crossbar shank square tips and said socket retaining parking stand square tips on the first end correspond in size to a $\frac{1}{2}$-inch drive.

* * * * *